US010368637B2

(12) United States Patent
Lenz

(10) Patent No.: US 10,368,637 B2
(45) Date of Patent: Aug. 6, 2019

(54) FURNITURE SYSTEM

(71) Applicant: Eberhard Lenz, Stuttgart (DE)

(72) Inventor: Eberhard Lenz, Stuttgart (DE)

( * ) Notice: Subject to any disclaimer, the term of this patent is extended or adjusted under 35 U.S.C. 154(b) by 0 days.

(21) Appl. No.: 15/549,313

(22) PCT Filed: Feb. 12, 2016

(86) PCT No.: PCT/EP2016/000243
§ 371 (c)(1),
(2) Date: Aug. 7, 2017

(87) PCT Pub. No.: WO2016/128142
PCT Pub. Date: Aug. 18, 2016

(65) Prior Publication Data

US 2018/0020831 A1 Jan. 25, 2018

(30) Foreign Application Priority Data

Feb. 12, 2015 (DE) ..... 10 2015 002 044

(51) Int. Cl.

| | |
|---|---|
| ***A47B 83/02*** | (2006.01) |
| ***A47B 9/00*** | (2006.01) |
| ***A47C 3/20*** | (2006.01) |
| ***A47C 31/12*** | (2006.01) |
| ***A47B 9/10*** | (2006.01) |
| ***A47C 3/30*** | (2006.01) |
| ***A47C 7/14*** | (2006.01) |
| *A47B 21/02* | (2006.01) |

(52) U.S. Cl.
CPC ..... *A47B 83/02* (2013.01); *A47B 9/00* (2013.01); *A47B 9/10* (2013.01); *A47C 3/20* (2013.01); *A47C 3/30* (2013.01); *A47C 7/14* (2013.01); *A47C 31/126* (2013.01); *A47B 21/02* (2013.01); *A47B 2200/0062* (2013.01)

(58) Field of Classification Search
CPC ... A47B 83/02; A47B 9/10; A47B 2200/0062; A47C 3/30; A47C 7/14
USPC ..... 297/174 R
See application file for complete search history.

(56) References Cited

U.S. PATENT DOCUMENTS 6,644,742 B1 11/2003 Walser
RE38,884 E * 11/2005 Kakii ..... H04N 7/144 348/14.08
6,964,370 B1 * 11/2005 Hagale ..... A47C 31/008 235/380

(Continued)

FOREIGN PATENT DOCUMENTS

DE 20 2004 012 430 U1 12/2004
DE 20 2004 012 430 U1 1/2005

(Continued)

*Primary Examiner* — Mark R Wendell
(74) *Attorney, Agent, or Firm* — Muncy, Geissler, Olds & Lowe, P.C.

(57) ABSTRACT

The invention relates to a furniture system, consisting of a height-adjustable chair and a height-adjustable table. According to the invention, the chair and the table can be height-adjusted synchronously by means of a common control device, wherein the height adjustment of the table and the height adjustment of the chair are synchronized with each other in such a way that, at different heights, an ideal distance between the tabletop and the seat surface of the chair is always maintained.

8 Claims, 2 Drawing Sheets

(56) References Cited

U.S. PATENT DOCUMENTS

| | | | | |
|---|---|---|---|---|
| 2009/0273441 | A1 | 11/2009 | Mukherjee | |
| 2011/0245979 | A1 | 10/2011 | Koch | |
| 2016/0075034 | A1* | 3/2016 | Laurent | H04L 12/282 700/264 |

FOREIGN PATENT DOCUMENTS

| | | | |
|---|---|---|---|
| DE | 10 2008 018 654 | B4 | 10/2010 |
| DE | 10 2009 053 312 | A1 | 5/2011 |
| DE | 10 2010 046 769 | A1 | 3/2012 |
| EP | 1 176 891 | B1 | 2/2003 |
| WO | WO 02/07567 | A1 | 1/2002 |
| WO | WO 2010/040749 | A1 | 4/2010 |

* cited by examiner

FURNITURE SYSTEM

This nonprovisional application is a National Stage of International Application No. PCT/EP2016/000243, which was filed on Feb. 12, 2016, and which claims priority to German Patent Application No. 10 2015 002 044.7, which was filed in Germany on Feb. 12, 2015, and which are both herein incorporated by reference.

BACKGROUND OF THE INVENTION

Field of the Invention

The invention relates to a furniture system and to a chair for acting together with a furniture system of the invention.

Description of the Background Art

Furniture systems are known in general in which the chair and increasingly the associated table as well are usually adjustable in height. As a rule, at least the setting made for the chair is retained for a long time, and the table is occasionally adjusted so that work can be performed while standing. This option is chosen by users who wish to obtain relief from back problems in this way. It is well known that it is basically necessary to bring more physical activity into our daily lives and to change our sitting habits so that we stand up for at least three to five minutes two to three times per hour. This frequent and brief straightening up of the body gives the body cells sufficient impetus to maintain crucial metabolic processes or to restart them.

An electrically height-adjustable chair, particularly a hairdresser chair, a dentist chair, or the like, with a lifting unit which can be electrically driven is known from DE 102008018654 B4. The chair can be adjusted in its height, without the chair having to be released for the height adjustment, as is customary in a height adjustment by means of a gas spring. The lifting unit may be hydraulic in which a pump is actuated by an electric motor. Alternatively, a toothed rack or a spindle drive with an electric motor is also conceivable.

The height adjustment of tables is usually carried out by means of spring systems, gas springs, or by means of an electric motor in conjunction with threaded rods. The systems with springs and gas springs have the advantage that they are inexpensive and enable a rapid adjustment and the disadvantage that time and again they result in different and possibly ergonomically unfavorable positions. In the case of an electrical adjustment, this disadvantage can be avoided relatively easily by a programmable preset. Nevertheless, this leads to interruptions in the workflow because the adjustment lasts for a certain time. In addition, many of the still relatively few people overall with access to a height-adjustable table are generally so absorbed in their work that in any case they do not make the frequent adjustment of the table, desirable from the medical point of view.

An ergonomic furniture system is known from DE 102009053312 A1 which consists of an electrically height-adjustable table and chair and in which the height-adjustable table wirelessly receives the height of the chair from the chair and moves the table top electrically into an ergonomic favorable position relative to the chair. Furthermore, the seat comprises a plurality of electrically controllable drives which, in addition to seat height, can adjust various regions, e.g., the backrest position, the lumbar support position, and the armrest position of the seat and thus adapt them to the user.

A lifting column unit for the electromotive adjustment of a height-adjustable furniture piece, in particular a table, is known from DE 102010046769 A1. A control device disposed in the motor housing controls the drive motor for retracting and extending the particularly telescopic lifting column.

A chair whose height can be adjusted by means of a gas spring and in which the contour of the chair's seat surface is forcibly mechanically changed when the chair height is adjusted is known from EP 1176891 B1.

A device for programming control data into a control unit for actuating functional elements on functional furniture such as adjustable tables or chairs is known from DE 202004012430 U1. In particular, a removable storage element such as a chip card is proposed.

Further disadvantages in the effort to introduce physical activity into sitting during office work with the help of a height-adjustable table result from the office chairs customary today. Their changeability of the seat height is generally limited to adaptation to the different body heights of the users when sitting, wherein the angle between the body and the thigh should be 90° according to the standard. This takes into account the fact that hardly any rather great height differences can be overcome by the usual means, namely, a gas spring in conjunction with the available installation space. This in turn has the result that the user of a height-adjustable table has the choice either to sit with the table at the sitting height or to stand while the office chair is useless and out of place in the work area. In addition, standing up from the normal seat height is rather arduous and the user has no support when standing at the table. For this reason, the user will not endure the upright or standing position for long and certainly not do this two or three times per hour, as would be desirable from the medical point of view.

In order to prevent users from becoming too tired during standing desk work, standing aids are conceivable as they are used for predominantly standing activities. They are distinguished by a smaller and narrower seat surface, because the large seat surface, required for normal office chairs for good load distribution, therefore when the angle between body and thigh is significantly greater than 90° (180° when standing), detrimentally affects the blood circulation in the thigh. In this set-up, two seating units, namely an office chair with a normal seat surface and a standing aid with a small seat surface, must be kept available at the workplace, which is disadvantageous because of the additional space requirement and the additional cost.

SUMMARY OF THE INVENTION

The object of the invention is to refine a furniture system or a chair in such a way that the user's health is promoted.

In other words, the invention relates to a furniture system for active sitting, comprising an electrically height-adjustable table and an electrically height-adjustable chair, wherein the height adjustment of the table and chair is synchronized with each other in such a way that, at different heights, an ideal, in particular an ideal vertical, distance between the table top and the seat surface of the chair is always maintained. Ideally, the distance between the table top and the chair is determined beforehand based on the viewpoints of work ergonomics and does not change during the height adjustment. If, for example, the distance is determined from the fact that the elbow of the seated user must be able to rest relaxed on the table top, this requirement determines the distance regardless of the height between the table top and seat surface. More generally, the distance can also slightly change with the height adjustment, in terms of a correction value, if, e.g., in a lower position, the seat surface of the chair is closer to the table top than in an upper position. The ideal distances in an extreme lower and extreme upper position can be specified, and intermediate positions are extrapolated.

An electrical adjustment of the table or chair can occur, for example, by controlling an electric motor whose shaft meshes with a gear rack by means of a toothed wheel or rotates a threaded rod, or by controlling an electric motor driving a pump for a pneumatic or hydraulic medium. The medium in turn fills or empties a pressure cylinder, connected to the seat surface or the table top, and thus adjusts the height thereof.

The common control device has the advantage that the furniture system comprising the table and chair is moved as a whole in its height and an ergonomically advantageous distance between the table top and the seat surface always remains set. The control device can either be integrated into the table or chair or be located in an independent housing like a TV control. The motors for the table or chair can also be controlled via smartphones or computers with a wireless connection. The control system stores at least two positions, namely, the lower position (working in the sitting position) and the upper position (working with the standing aid), in each case with the optimal ergonomic distance between the table and chair. A control system of this kind can also store different user profiles and intermediate positions in a retrievable manner, so that the adjustment can be made centrally and, in the case of flexible workstations, the profiles of the particular users can be retrieved at any location.

The control system may include anti-pinch protection which prevents a user from pinching the fingers between the underside of the table top and an obstacle placed under the table when the table is lowered. For example, the anti-pinch protection can consist of a current query when the table is lowered. If the motor current exceeds a threshold, this indicates an increased resistance due to possible pinching.

In a refinement, the furniture system can be moved from a lower position to an upper position program-controlled at predefined time intervals. The method can also be made dependent on an arbitrary release by the user. Examples of this are: with or without audible signal, automatically or after manual release (intentional release), slow or fast, with or without intermediate positions.

In a refinement, the seat surface is simultaneously adapted depending on the height of the chair, so that it is flat at a normal seat height (low height) and narrow and curved upwards, at least in the front area, like a saddle at a high seat height.

In the combination of refinements, the advantage results with automated control that the user can perform the two to three alternations per hour between sitting and standing with a standing aid, which is recommended for maintaining performance and health, without being distracted by the change in position and having to interrupt his work.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1A:
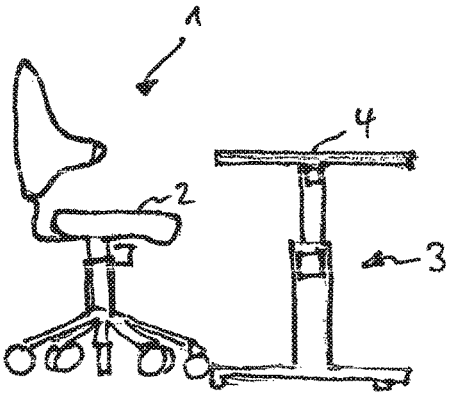
FIG. 1*a* the furniture system of the invention in the low position.
Figure 1B:
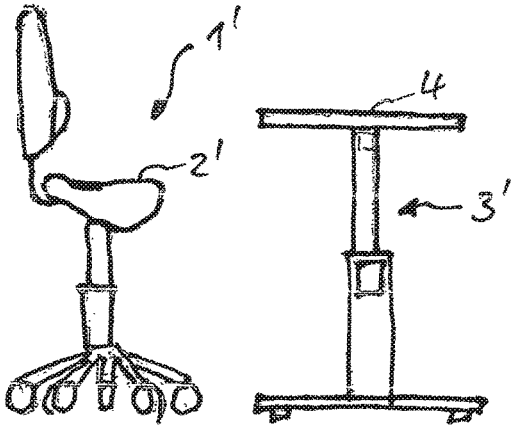
FIG. 1*b* the furniture system of the invention in the high position.

A task of the invention is to produce a synchronous height adjustment of table 3 and chair 1, in the case of the furniture system of the invention in FIGS. 1*a* and 1*b*. Although the synchronous height adjustment can of course also take place by mechanical means (lever, threading, spring tension, gas springs), an electronic control is preferable. Positions 1, 2, 3 show the chair, seat surface, and table each in the lower position and positions 1', 2', 3' each in the upper position.

A further advantage of the electrical height adjustment of chair 1 is that greater height differences can be overcome with an electrically driven telescopic extension than with a conventional gas spring. Further advantages consist of possible electronic position feedback and in that the user need not release the seat for height adjustment.

Figure 2A:
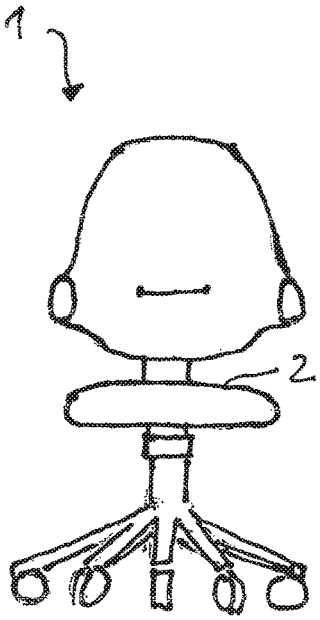
FIGS. 2*a* and 2*b* show the adaptation of the chair as a function of height.
Figure 2B:
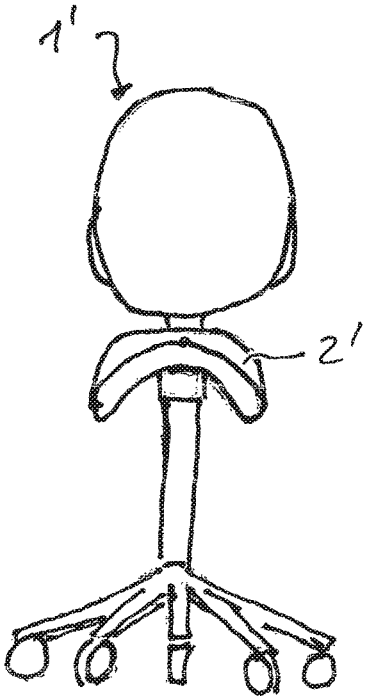

The adaptation of the chair as depicted in FIGS. 2*a* and 2*b* as a function of the height can be basically addressed by usual means, such as gas springs and linkages.

However, one or more electrical drives are also more advantageous here because of the simpler synchronization with the central control unit. It is achieved thereby that the seat surface of the chair, in particular of an office chair, can be changed as a function of its height, so that it is large at a normal seat height and narrow, therefore saddle-shaped in particular in the front region of the seat surface, at a high seat height. It is also conceivable that the seat surface is slightly inclined forward in the high seat height. Positions 1, 2 show the chair and the seat surface each in the lower position or height and positions 1', 2' each in the upper position or height.

Furthermore, seat 1 can have a plurality of electrically controllable drives in the backrest, which can adjust various areas, e.g., the backrest position, lumbar support position, and the armrest position of the seat, and thus adapt them to the user and the chair height.

Figure 3:
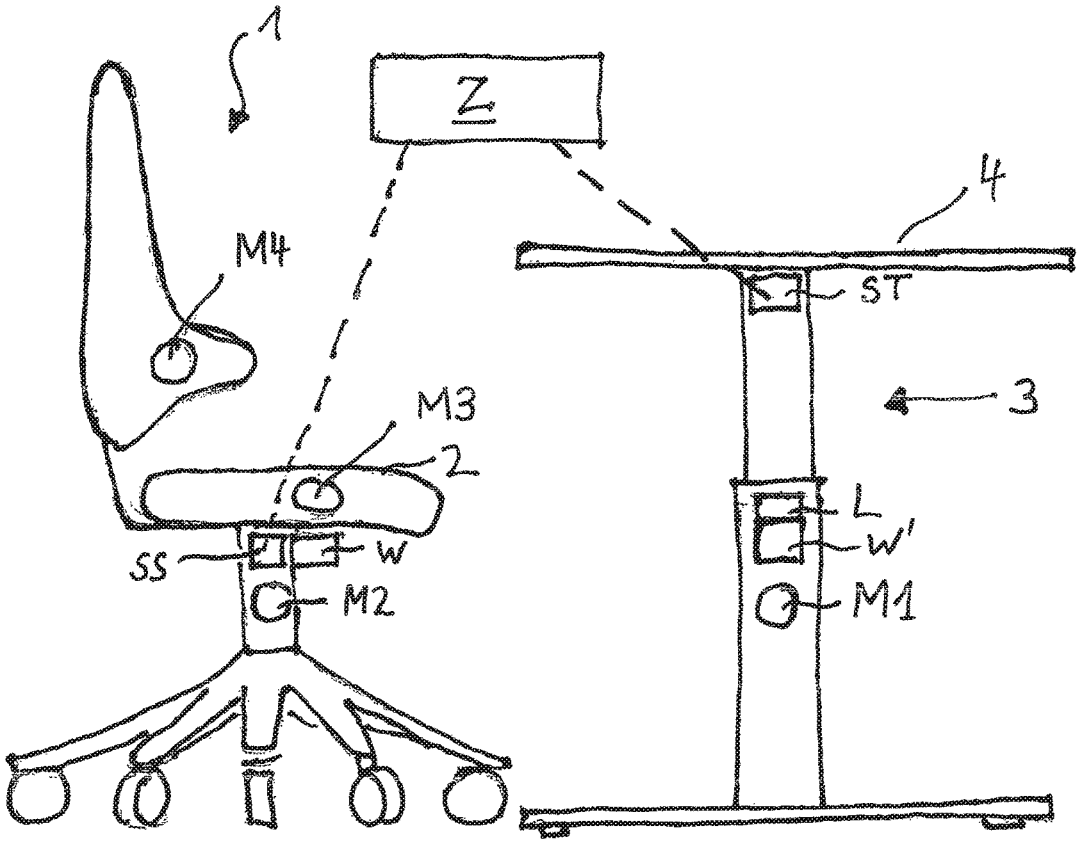
FIG. 3 shows the structure of the furniture system of the invention.

For the electrical height adjustment of the furniture system shown in FIG. 3, a central control unit Z is connected in each case to a decentralized control unit SS and ST to table 3 and chair 1 via a wireless communication path (indicated by broken lines in FIG. 3). The electrical height adjustment of table 3 and chair 1 offers the advantage that a synchronization of the adjustment can be easily implemented. Wired systems are also considered in general as a connection between control unit Z and table 3 and chair 1, but wireless systems such as, for example, infrared, Bluetooth, and WLAN are to be preferred.

The height adjustment of tables is usually carried out by means of springs, gas springs, or electric drives, and of chairs by means of gas springs or simple spindles. The synchronous height adjustment of table 3 and chair 1 is basically conceivable for the mechanical systems by means of sensors and a valve control of the gas spring. However, the embodiment with electrical drives in particular offers the advantage that they can be easily synchronized via a central control unit.

Overall, therefore, at least three electrical drives are controlled by the central control unit Z: the height adjustment of the table M1, as well as the height adjustment of the chair M2, and the seat surface adjustment M3 of the chair, each controlled by an associated control unit. One control unit SS is integrated in the chair, and the other control unit ST for the table is disposed in the table. Of course, because the chair has a power supply, it is also conceivable that the backrest or armrests are controlled electronically, as is indicated by electric motor M4. The drives in the table are supplied with power by a direct connection to the general power supply (not shown) or via solar cells (not shown) attached to the table, and in the chair by means of rechargeable batteries W, W', charged via a charging station L at the table. Power is supplied to central control unit Z by means of small rechargeable batteries or, if central control unit Z is fixedly connected to the table or chair, by direct connection to its respective power supply.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A furniture system, comprising:

a height-adjustable chair; and a height-adjustable table, wherein the height-adjustable chair and the height-adjustable table are adjustable in height by means of a common control device, wherein height adjustment of the height-adjustable table and the height-adjustable chair is synchronized with each other to maintain a distance between a top of the height-adjustable table and a seat surface of a seat of the height-adjustable chair, and wherein the common control device is configured to automatically adjust the height-adjustable chair and the height-adjustable table from a lower position to an upper position and the upper position to the lower position at scheduled intervals two or three times per hour, the scheduled intervals being triggerable by a single user.

2. The furniture system according to claim 1, wherein the common control device moves the height-adjustable chair and the height-adjustable table from the lower position to the upper position and vice versa in accordance with a program at predefinable time intervals.

3. The furniture system according to claim 1, wherein in the lower position in the case of the chair, at least the seat surface is adapted so that it is flat, and in the upper position the seat surface is narrow and curved upwards like a saddle.

4. The furniture system according to claim 1 wherein the height adjustment of the table or of the chair occurs by means of electrical, hydraulic, or pneumatic pressure cylinders.

5. A height-adjustable chair for acting together with a furniture system, wherein a height of the height-adjustable chair is configured to be adjusted with respect to a table associated with the height-adjustable chair by a control unit, wherein a distance between a table top of the table and a seat surface of the height-adjustable chair is always maintained, and wherein the height-adjustable chair is adjustable in height between a low height and a high height by the control unit, and the control unit can automatically move the chair from the low to the high height and vice versa at scheduled intervals two or three times per hour, the scheduled intervals being triggerable by a single user.

6. The chair according to claim 5, wherein at the lower height, at least the seat surface is adapted so that it is flat, and at the high height the seat surface is narrow and curved upwards like a saddle.

7. A furniture system, comprising:

a height-adjustable chair;

a height-adjustable table; and a common control device configured to adjust a height of the height-adjustable chair and the height-adjustable table, wherein height adjustment of the table and the chair is synchronized to maintain a preset distance between a top of the height-adjustable table and a seat surface of a seat of the height-adjustable chair, and wherein the common control device is configured to adjust the height-adjustable chair and the height-adjustable table from a lower position to an upper position and the upper position to the lower position in accordance with a program at predefinable time intervals, the predefinable time intervals being triggerable by a single user.

8. A furniture system, comprising:

a height-adjustable chair;

a height-adjustable table; and a common control device configured to adjust a height of the height-adjustable chair and the height-adjustable table, wherein height adjustment of the table and the chair is synchronized to maintain a preset distance between a top of the height-adjustable table and a seat surface of a seat of the height-adjustable chair, and wherein the common control device is configured to adjust the height-adjustable chair and the height-adjustable table from a lower position to an upper position and the upper position to the lower position when intentionally triggered by a single user.

* * * * *